US010139106B2

(12) United States Patent
Vendramini

(10) Patent No.: US 10,139,106 B2
(45) Date of Patent: Nov. 27, 2018

(54) METHOD AND SYSTEM FOR CONTROLLING THE OPERATION OF A BURNER

(71) Applicant: SIT S.p.A., Padua (IT)

(72) Inventor: Antonio Vendramini, Padua (IT)

(73) Assignee: SIT S.P.A., Padova (IT)

( * ) Notice: Subject to any disclaimer, the term of this patent is extended or adjusted under 35 U.S.C. 154(b) by 55 days.

(21) Appl. No.: 14/901,963

(22) PCT Filed: Jul. 1, 2014

(86) PCT No.: PCT/IB2014/062770
§ 371 (c)(1),
(2) Date: Dec. 29, 2015

(87) PCT Pub. No.: WO2015/001487
PCT Pub. Date: Jan. 8, 2015

(65) Prior Publication Data

US 2017/0003024 A1 Jan. 5, 2017

(30) Foreign Application Priority Data

Jul. 2, 2013 (IT) ..... PD2013A0186

(51) Int. Cl.
*F23N 5/24* (2006.01)
*F23N 5/20* (2006.01)

(52) U.S. Cl.
CPC ..... *F23N 5/203* (2013.01); *F23N 5/24* (2013.01); *F23N 2023/04* (2013.01);
(Continued)

(58) Field of Classification Search
CPC ..... F23N 5/203; F23N 5/24; F23N 2023/08; F23N 2023/38; F23N 2023/54; F23N 2021/10
(Continued)

(56) References Cited

U.S. PATENT DOCUMENTS 4,348,169 A 9/1982 Swithenbank et al.
4,545,009 A * 10/1985 Muraki ..... F23N 1/022 431/12
(Continued)

FOREIGN PATENT DOCUMENTS

EP 0616172 A1 9/1994
JP 01302023 A * 12/1989 ..... F23N 1/022
(Continued)

*Primary Examiner* — Gregory Huson
*Assistant Examiner* — Daniel E Namay
(74) *Attorney, Agent, or Firm* — Volpe and Koenig, P.C.

(57) ABSTRACT

A method for controlling the operation of a burner, the burner including a control board with a first control unit and a first memory, which stores first values of operating parameters of the burner, and a display device, which displays one or more items of data relating to the functioning of the burner, the display device including a second memory, which stores second values of operating parameters of the burner, each first and second operating parameters being capable of being changed over time. The method includes setting for each operating parameter at least one first value in the first memory, and at least one second value in the second memory; comparing, for each operating parameter, a corresponding first value and second value; if the first value and the second value are different, changing one of the first or second values, so that the first and second values are the same.

22 Claims, 2 Drawing Sheets

(52) U.S. Cl.
CPC ..... *F23N 2023/08* (2013.01); *F23N 2023/38* (2013.01); *F23N 2023/54* (2013.01); *F23N 2031/10* (2013.01)

(58) Field of Classification Search
USPC ..... 431/12, 75
See application file for complete search history.

(56) References Cited

U.S. PATENT DOCUMENTS 4,653,998 A * 3/1987 Sohma ..... F23N 5/006 110/186
5,120,214 A * 6/1992 West ..... F23N 5/16 431/12
5,211,331 A * 5/1993 Seel ..... F23N 1/042 126/92 AC
5,612,904 A * 3/1997 Bunting ..... F23N 5/242 431/13
5,866,802 A * 2/1999 Kimata ..... G01M 3/2815 431/12
5,984,663 A 11/1999 Joyce
6,050,807 A * 4/2000 Baek ..... F23N 5/082 122/DIG. 7
6,247,918 B1 * 6/2001 Forbes ..... F23N 5/082 431/12
6,279,870 B1 * 8/2001 Welz, Jr. ..... F16K 27/0218 251/129.04
6,361,310 B1 * 3/2002 Fastnacht ..... F23N 5/003 431/12
6,428,308 B1 * 8/2002 Bird ..... F23N 1/005 126/39 BA
6,533,574 B1 * 3/2003 Pechoux ..... F23N 5/188 431/12
6,595,430 B1 * 7/2003 Shah ..... F23N 5/203 165/238
6,955,535 B2 * 10/2005 Diebold ..... F23N 5/265 137/101.19
7,020,543 B1 * 3/2006 Jaeschke ..... F23N 5/00 219/497
7,118,613 B2 * 10/2006 Crawley ..... F01N 3/025 95/278
7,651,034 B2 * 1/2010 Weimer ..... F23N 3/082 236/11
7,908,847 B2 * 3/2011 Crawley ..... F01N 3/025 431/12
8,261,733 B2 * 9/2012 Hugghins ..... F23N 1/022 126/112
8,444,041 B2 * 5/2013 Perry ..... B23K 1/00 137/88
8,475,162 B2 * 7/2013 Barritt ..... F23N 1/002 126/39 BA
8,695,887 B2 * 4/2014 Helt ..... G05D 23/1931 236/1 C
8,721,325 B2 * 5/2014 Geiger ..... F23N 1/022 236/11
9,765,965 B2 * 9/2017 Kowald ..... F23N 5/203
9,810,156 B2 * 11/2017 Terry ..... F02C 9/00
2002/0142257 A1 * 10/2002 Eroglu ..... F02C 9/28 431/12
2007/0045441 A1 * 3/2007 Ashworth ..... G05D 23/1902 236/94
2007/0175624 A1 * 8/2007 Affolter ..... F23N 5/242 165/287
2008/0096147 A1 * 4/2008 Newsom ..... F23N 1/00 431/12
2008/0099570 A1 * 5/2008 Krebs ..... F23N 5/203 236/46 R
2008/0154546 A1 * 6/2008 Kato ..... F23N 5/203 702/187
2008/0182214 A1 * 7/2008 Cox ..... F23N 1/045 431/12
2008/0293001 A1 * 11/2008 Bohan, Jr. ..... F23N 5/203 431/76
2009/0001181 A1 * 1/2009 Siddaramanna ..... F23N 5/203 236/46 R
2012/0048955 A1 * 3/2012 Lin ..... F23N 5/203 236/46 R
2012/0083194 A1 * 4/2012 Hagensen ..... F23J 11/02 454/16
2013/0122433 A1 * 5/2013 Labbe ..... F23N 5/00 431/12
2014/0295360 A1 * 10/2014 Wiklof ..... F23N 1/002 431/12

FOREIGN PATENT DOCUMENTS

JP 03229301 A * 10/1991 ..... F23N 1/002
JP 05248628 A * 9/1993
JP 05332532 A * 12/1993
JP 2015108375 A * 6/2015 ..... F23M 11/00

* cited by examiner

METHOD AND SYSTEM FOR CONTROLLING THE OPERATION OF A BURNER

This invention relates to a method and a system for controlling the operating parameters of a burner such as for example a boiler.

The invention also relates to a method and a system for updating the set parameters of a control system for burners, and a method for processing the data produced by that control system.

The invention relates particularly, but not exclusively, to the sector of systems for the multifunctional control of heating devices, in particular environmental or domestic hot water heating equipment, for example burners and boilers.

According to the known art, modern burners normally comprise a control board capable of managing the functions of the burner through a control system. The board is normally provided with a control unit, such as a microprocessor or microcontroller, it is able to manage and control the various functions of the burner, together with other items mounted on the board, such as, for example, non-volatile memories, volatile memories and input/output interfaces.

In particular, in order to control and manage operation of the burner, provision is normally made for the use of plurality of parameters, known as operating parameters, whose required values are set and stored in memory on non-volatile memory media, in order to establish a particular mode of operation for the burner.

Typically the operating parameters are subdivided into two types, that is user parameters and set parameters.

The user parameters, whose values can be set and changed by the burner's user, comprise the operating parameters for the burner, that is for example the operating temperature and the times when the water circulating pump is switched on and off.

Some of the set parameters are however set by the company manufacturing the burner and/or the burner installer and cannot usually be altered by the burner's user. In the case in point specialist technicians are able to alter these parameters during the course of extraordinary or scheduled maintenance work, or when the burner is repaired or it is necessary to replace one or more of its components.

The set parameters comprise parameters controlling the burner and a plurality of parameters relating to the burner unit, such as power and type of burner, characteristics, dimensions, flue diameter, flue damping coefficient.

The control parameters for a burner comprise, for example, a first safety parameter, indicating the waiting time needed to check that a flame is present within the combustion chamber of the burner after the signal for igniting it has been started, a second parameter relating to post-ventilation of the combustion chamber to remove combustion gases, a third parameter associated with a predetermined value of the burner operating temperature and others also.

As is known, because user's requirements and/or burner operating conditions may change over the time in which it is in use the values given to user parameters and set parameters may change over time.

For example, in the course of operation it may occur that obstruction of the flue increases because of the gases produced by combustion in the burner. In this case provision may be made for changing the values given to the user and/or set parameters in order to achieve optimum operation of the burner.

In order to achieve optimum operation modern burners provide for automatic adjustment of one or more set parameters, that is to say the burner automatically changes the set parameters through a learning process so that these adjust to the new operating conditions set by the user or by a specialist engineer, or again which are appropriate for new external conditions.

Modern burners may also provide for automatic adjustment of one or more user parameters, such as adjusting the switching on and switching off of environmental heating on the basis of manual settings by the user.

As previously indicated, burners require ordinary maintenance in order to check that they are in proper working order in accordance with national standards, thus increasing the safety of the system and ensuring high energy efficiency over time.

Extraordinary maintenance may also be carried out in order to check or, if necessary, repair any malfunctions in the control system and/or the breakdown of one or more components of the burner.

In order to restore burner function it is advantageous to store the last values set for user parameters and/or set parameters in a memory in the burner, together with a history of the values used for user parameters and/or set parameters during the period for which the burner has been in use. This period of use may coincide with a particular period of time or may go back to the time when the burner was installed. As is known, storing historical user and set parameters in memory allows the burner control system to make automatic changes in the adjustment parameters which are potentially better than automatic changes based only on the latest set values for user parameters and/or set values, thus for example, making it possible to establish statistical indicators such as mean value and variance for such parameters.

Various control boards for burners are available in the market. Three examples of different configurations of known control boards are shown diagrammatically in FIGS. 2-4.

These control boards provide a non-volatile memory, designed to store a history of the last values used for the set parameters and the user parameters.

In accordance with a first embodiment, illustrated in FIG. 2, a control board 10 comprises a microprocessor 11 capable of managing and controlling the various functions of the burner and a non-volatile memory 12 for the storage of data such as set parameters and user parameters.

In a second embodiment, illustrated in FIG. 3, provision is made for a control board 20 comprising a microprocessor 21 incorporating a non-volatile memory unit 22 to store the set parameters and user parameters, a volatile memory 23 and I/O ports 24.

A third embodiment, illustrated in FIG. 4, provides for an electronic control board 30, provided with an incorporated microprocessor 31 and a non-volatile external memory 32 connected to electronic port 30 through a data transmission cable 33. Memory 32 can be used to store set parameters and user parameters.

It will be understood that it may be necessary to replace the control board following malfunctions, or the breakdown of one or more of the burner components.

Where the control board is constructed in one of the modes illustrated in FIGS. 2 and 3, this replacement results in the loss of the data stored in non-volatile memory 12, 22, that is the loss of values given to the set parameters and user parameters and any other information which has been stored in non-volatile memory 12, 22, the latter being mounted directly on control board 10, 20 which requires replacement.

The same problem arises to a greater extent in the case where the burner has to be completely replaced, because information relating to the set parameters for the system and the user parameters is lost, together with the historical changes in the values given to those parameters.

In the absence of such information setting up the new burner or the new board obviously requires more time for placing the burner in operation. In the worst case the settings for the new burner may not be perfectly satisfactory.

The abovementioned problem is overcome in the known art by using a control board which is configured in the same way as control board 30 illustrated in FIG. 4.

This embodiment in fact provides for a non-volatile memory 32, which is separate from control board 30 but connected to it through a data transmission cable 33.

If the burner is replaced this solution makes it possible to avoid losing the data stored in external memory 32, that is the set parameters and the user parameters, because external memory 32 can be disconnected from control board 30 requiring replacement and can subsequently be connected to a new replacement control board.

However, because of the cost of external memories, such an embodiment has a very high production cost which is greater than for the known embodiments previously described. This greatly restricts the extent to which this solution is used.

A burner control system according to the known art is for example, described in U.S. Pat. No. 4,348,169.

The technical problem underlying the invention is that of providing a method and a system for controlling the function of a burner which is structurally and functionally designed to overcome all the disadvantages mentioned with reference to the cited known art.

A further object is that of providing a method and a system for controlling the set parameters and user parameters for a burner which is economic and reliable.

Characteristics of this invention and its manner of use will be apparent from the following detailed description of a number of embodiments provided by way of example and without limitation in the appended figures, in which.

Figure 1:
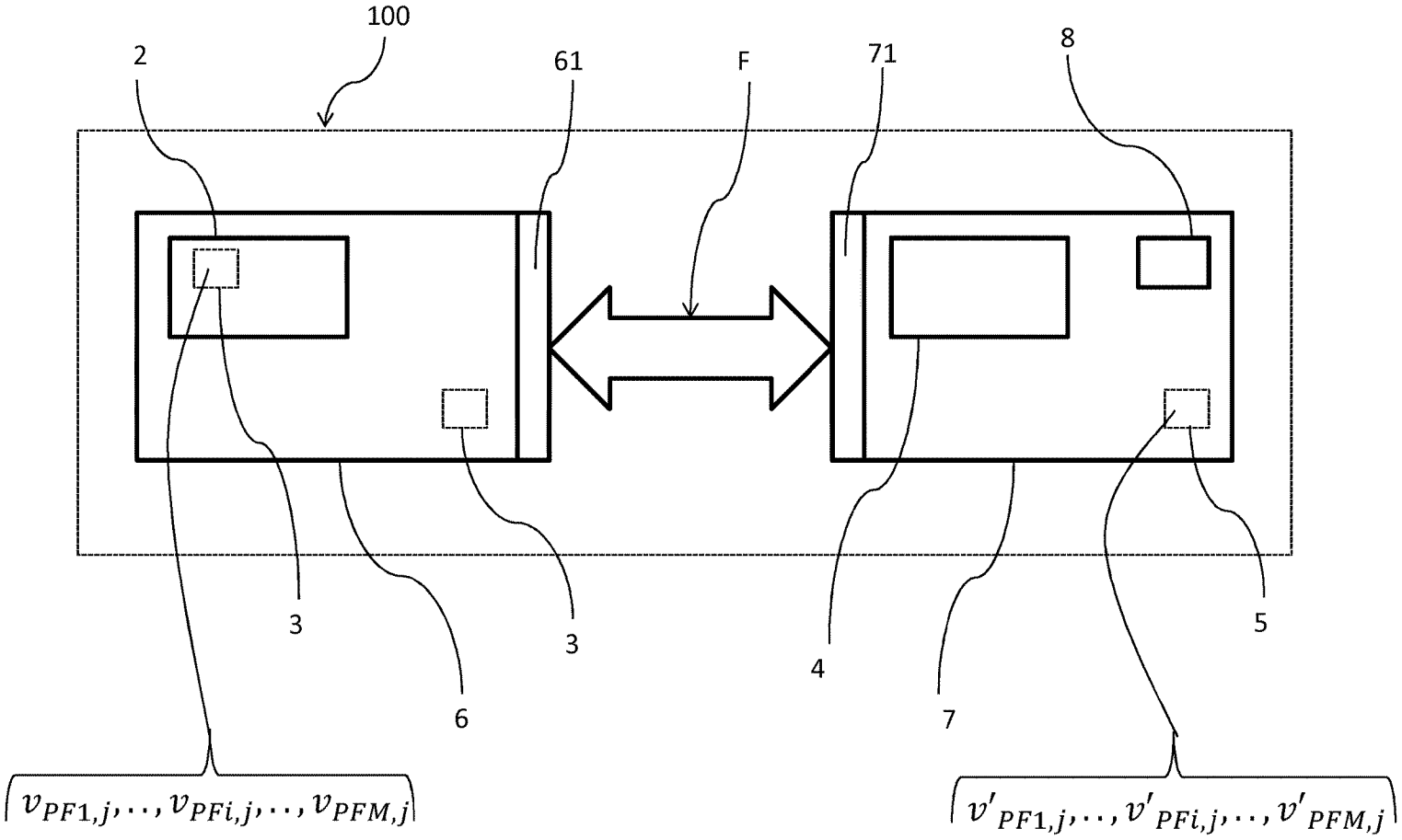
FIG. 1 is a diagram of a control system for the burner according to the invention.
Figure 3:
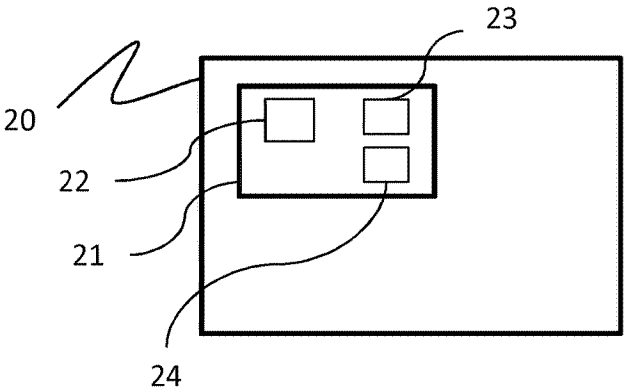
FIG. 3 is a diagram of a second type of control board for a burner constructed according to the known art.
Figure 2:
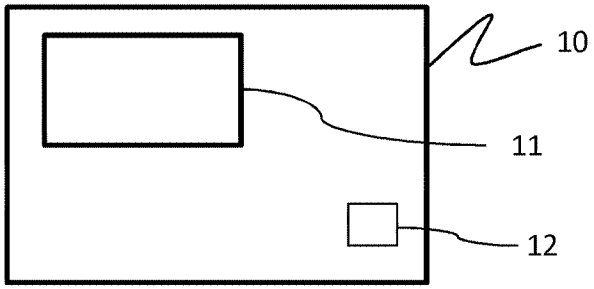
FIG. 2 is a diagram of a first type of control board for a burner constructed according to the known art.
Figure 4:
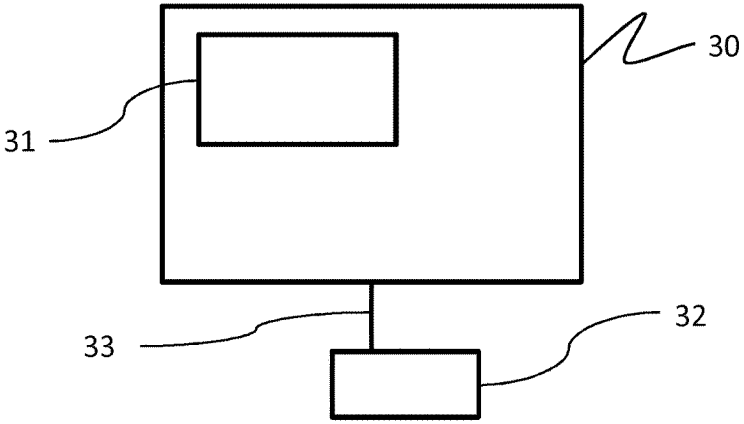
FIG. 4 is a diagram of a third type of control board for a burner constructed according to the known art.

With reference to FIG. 1, 100 indicates, as a whole, a control system according to this invention which is suitable for controlling a burner, a boiler, a heating system, etc., which are not illustrated in the figures.

In a preferred embodiment control system 100 comprises a control board 6, preferably within the burner, provided with a first control unit, such as a microprocessor 2, and a first data memory unit, such as a first memory 3 of the non-volatile type, for storing data, for example first values $\nu_{PF1,j}, \ldots, \nu_{PFi,j}, \ldots, \nu_{PFM,j}$ of operating parameters $P_{F1}, \ldots, P_{Fi}, \ldots, P_{FM}$ of the burner. Through microprocessor 2 it is possible to set the first values $\nu_{PF1,j}, \ldots, \nu_{PFi,j}, \ldots, \nu_{PFM,j}$ of the abovementioned operating parameters $P_{F1}, \ldots, P_{Fi}, \ldots, P_{FM}$ and to manage operation of the burner by controlling actuator means for the burner, which are in themselves known, in order to operate the burner and adjust its operation on the basis of the values of the aforesaid operating parameters.

Operating parameters $P_{F1}, \ldots, P_{Fi}, \ldots, P_{FM}$ comprise set parameters $P_{R1}, \ldots, P_{RT}$ and user parameters $P_{U1}, \ldots, P_{UL}$; set parameters $P_{R1}, \ldots, P_{RT}$ in turn comprise parameters for controlling the burner and a plurality of parameters relating to the heating system, user parameters $P_{U1}, \ldots, P_{UL}$ comprise the operating parameters for the burner, as will be more particularly explained below. Control system 100 further comprises a display device 7, provided with a second control unit, such as a second microprocessor 4, and a second data memory unit such as a second memory 5, of the non-volatile type, to store data, including second values $\nu'_{PF1,j}, \ldots, \nu'_{PFi,j}, \ldots, \nu'_{PFM,j}$ of operating parameters $P_{F1}, \ldots, P_{Fi}, \ldots, P_{FM}$ of the burner. Second memory 5 may be incorporated in microprocessor 4 or may be separate from microprocessor 4.

Display device 7 comprises a display 8 capable of displaying one or more items of data to the burner's user, such as first values $\nu_{PF1,j}, \ldots, \nu_{PFi,j}, \ldots, \nu_{PFM,j}$ and/or second values $\nu'_{PF1,j}, \ldots, \nu'_{PFi,j}, \ldots, \nu'_{PFM,j}$ of operating parameters $P_{F1}, \ldots, P_{Fi}, \ldots, P_{FM}$ stored in first memory 3 or second memory 5 respectively. In a version which is not shown the display device is external to the burner and preferably installed within a dwelling house.

In a preferred version, display device 7 is incorporated into the burner, mounted on the burner, i.e. placed on the burner in a way which is accessible to a user of the burner.

Display device 7 is operatively connected to control board 6, and it is therefore possible, through display device 7, to gain access to both first memory 3 and second memory 5 and therefore to change both the first and second values of the burner's operating parameters.

This arrangement advantageously makes it possible to provide a burner which is operatively independent and incorporates both control board 6 and display device 7, for both first memory 3 and second memory 5.

Display device 7 therefore enables the user of the burner to set first user parameter values for each user parameter, $P_{U1}, \ldots, P_{UL}$, and for each set parameter, $P_{R1}, \ldots, P_{RT}$ and to store them in first memory 3, and/or second values of user parameters and store them in second memory 5.

The values of these parameters may be set and/or changed by the user at any time through display device 7 and for ease of use are preferably continuously displayed in display 8.

In other words, display device 7 makes it possible to both set and display one or more items of data relating to operation of the burner.

However any location of display device 7 in space, including within the burner itself, is provided for in this invention.

The burner constitutes a single apparatus comprising control board 6 and display device 7, which are functionally and structurally connected together. In particular display device 7 is configured to display and set first and/or second values of operating parameters $P_{F1}, \ldots, P_{Fi}, \ldots, P_{FM}$ during installation of the burner or during installation and/or replacement of at least part of the burner control system, and while the burner itself is functioning.

In one embodiment of the invention display device 7 is provided with a user interface, preferably a graphic interface, through which a user may display and set first and/or second values of operating parameters $P_{F1}, \ldots, P_{Fi}, \ldots, P_{FM}$. For each first value, $\nu_{PF1,j}, \ldots, \nu_{PFi,j}, \ldots, V_{PFM,j}$, and second value, $\nu'_{PF1,j}, \ldots, \nu'_{PFi,j}, \ldots, \nu'_{PFM,j}$ respectively of operating parameters $P_{F1}, \ldots, P_{Fi}, \ldots, P_{FM}$, first and second memories 3, 5 can be used to store the corresponding attribution date $Date_{\nu_{PFij}}$, $Date'_{\nu_{PFij}}$ in memory.

First and second memory 3, 5 are also capable of storing a first and a second historical $V_{PFi}$, $V'_{PFi}$ respectively in memory for each operating parameter $P_{Fi}$. For each operating parameter $P_{Fi}$, the first and second historic values $V_{PFi}$, $V'_{PFi}$ respectively comprise all the first and second values $v_{PFi,j}$, $v'_{PFi,j}$ set for that operating parameter $P_{Fi}$ during a period when the burner has been in use, or over a period of time (T).

Therefore, for each operating parameter $P_{Fi}$, $$V_{PFi}=\{v_{PFi,1}; v_{PFi,2}; \ldots ; v_{PFi,j}; \ldots ; v_{PFi,N}\} \text{ and}$$

$$V'_{PFi}=\{v'_{PFi,1}; v'_{PFi,2}; \ldots ; v'_{PFi,j}; \ldots ; v'_{PFi,N}\}.$$

In addition to this first and second memories 3, 5 are capable of storing the attribution dates, $Date_{v_{PFij}}$, $Date'_{v_{PFij}}$ for such first and second values of the abovementioned operating parameters in memory.

The period of use may be the same as a specific time period or may go back to the time when the burner was installed.

In a preferred embodiment set parameters $P_{R1}, \ldots, P_{RT}$ comprise a first safety parameter, indicating the waiting time needed to check that a flame is present within the combustion chamber of the burner after the signal for igniting it has been started, a second parameter relating to post-ventilation of the combustion chamber, and a third parameter associated with a set-point for the burner operating temperature.

Further examples of set parameters $P_{R1}, \ldots, P_{RT}$ whose values may vary during the period when the burner is in use are as follows:

- the PID parameters of the PID controllers which may be present within control system 100 for controlling environmental heating via the burner;
- parameters relating the post-circulation of water through a pump incorporated in the burner;
- a set-point for the operating temperature of the burner, based on variations in the user parameters, such as the required ambient temperature, or the time when the burner should switch on;
- the maximum power delivered from the boiler when heating. This power may be a percentage of the maximum power which can be delivered by the boiler in order to prevent undesirable overheating of the heat exchanger when responding to repeated requests for heat;
- the timing for activation of the "night set-back" function, to change the burner's operating temperature set-point, based on the time of day (day-night);
- the temperature of anti-legionella function.

In a preferred embodiment, user parameters $P_{U1}, \ldots, P_{UL}$ comprise the operating temperature, or the environmental temperature set by the burner's user, the time when the burner is switched on, and the time when it is switched off.

Control board 6 and display device 7 each comprise an input/output I/O unit 61, 71 to provide for the two-way transmission of data, that is for sending and receiving data between control board 6 and display device 7 and vice versa, as indicated by arrow F in in FIG. 1.

In other words control board 6 may send data to display device 7 and receive data from display device 7, and vice versa.

The term "two-way transmission" also includes a type of data transmission in which data can travel simultaneously in a first direction and a second direction opposite to the first, that is the data can be transmitted from control board 6 to display device 7 and simultaneously from display device 7 to control board 6.

In particular, data transmission between control board 6 and display device 7 is of the two-way type when the burner is in operation.

The transmission of data between control board 6 and display device 7 takes place by data transmission means which are known in the art. This transmission may take place through electrical transmission means, such as coaxial cables, or optical transmission means, for example, optical fibres. As an alternative the transmission means may be of the wireless type, and may use Ethernet, Bluetooth or, preferably, Wi-Fi technology.

The data transmitted between control board 6 and display device 7 comprise first and second values $v_{PF1,j}, \ldots, v_{PFi,j}, \ldots, v_{PFM,j}, v'_{PF1,j}, \ldots, v'_{PFi,j}, \ldots, v'_{PFM,j}$ of the burner operating parameters.

The provision of two-way transmission between control board 6 and display device 7 allows a user to see and set first and/or second values for operating parameters $P_{F1}, \ldots, P_{Fi}, \ldots, P_{FM}$ (preferably at least the first and/or second values of user parameters $P_{U1}, \ldots, P_{UL}$) through display device 7 in order to control operation of the burner.

In addition, it is possible, through display device 7, to display and set first and/or second operating parameters $P_{F1}, \ldots, P_{Fi}, \ldots, P_{FM}$ stored in first and second memories 3, 5 respectively while the burner is in operation in such a way as to obtain immediate indication of the burner's response to adjustment of the abovementioned parameters.

Preferably, the first and/or second values of operating parameters $P_{F1}, \ldots, P_{Fi}, \ldots, P_{FM}$ are displayed by display 8 of display device 7, and are set and changed via the interface provided on display device 7, for example a keyboard, touchpad and/or directly by means of display 8 if it is of the touch-screen type.

Control system 100 may provide for the automatic and/or manual adjustment of the first values of set parameters $P_{R1}, \ldots, P_{RT}$ stored in first memory 3.

Preferably, display device 7 makes it possible to set the abovementioned automatic setting and to perform the abovementioned manual setting, for example via the user interface or display 8.

Automatic or manual adjustment of the first values for set parameters $P_{R1}, \ldots, P_{RT}$ makes it possible to vary the operating characteristics of the burner in order to obtain optimum performance, even under the various environmental conditions to which the burner may be subjected or for different states of wear of the burner due to its prolonged use.

In a preferred embodiment, control system 100 automatically changes the first values assigned to set parameters $P_{R1}, \ldots, P_{RT}$ through microprocessor 2, associating an attribution date $Date_{v_{PFij}}$ with each value.

In a preferred embodiment microprocessor 2 changes the set value of each set parameter $P_{R1}, \ldots, P_{RT}$ by making use of automatic learning algorithms, based on neutral networks or PID controllers, which can acquire and process signals originating from one or more sensors (not shown in the figures) located in the burner.

New first values for set parameters $P_{R1}, \ldots, P_{RT}$ together with attribution dates $Date_{v_{PFij}}$ and previous corresponding first values of such parameters are therefore stored in first memory 3.

Control system 100 provides for a specialist engineer to be able to change the last value set for each set parameter, $P_{R1}, \ldots, P_{RT}$, for example when installing or maintaining the burner. The specialist engineer will manually set the first values of set parameters $P_{R1}, \ldots, P_{RT}$ through the user interface, for example through a pop-up displayed in display 8.

In the same way as illustrated for automatic control, new first values attributed to set values $P_{R1}, \ldots, P_{RT}$ together with attribution dates $Date_{v_{PFij}}$ and historical data for these parameters, or the previous corresponding first values for such parameters, may be stored in first memory 3.

As an alternative, or in addition, control system 100 provides for the automatic and/or manual setting of second set parameters $P_{R1}, \ldots, P_{RT}$ stored in second memory 5, in the same ways as discussed previously, in the case of the first values stored in first memory 3.

Two-way transmission of data between control board 6 and display device 7 makes it possible to align the first values and the second values stored in first and second memories 3, 5 automatically and/or manually, as will be more particularly explained below, in such a way that the same value is stored for each operating parameter in first and second memories 3, 5. Control system 100 also provides for periodical alignment of first and second values $v_{PF1,j}, \ldots, v_{PFi,j}, \ldots, v_{PFM,j}, v'_{PF1,j}, \ldots, v'_{PFi,j}, \ldots, v'_{PFM,j}$ of operating parameters $P_{F1}, \ldots, P_{Fi}, \ldots, P_{FM}$; with a regular pre-set frequency control system 100 compares the most recent first and second values $v_{PFi,j}$, $v'_{PFi,j}$ set for that operating parameter $P_{Fi}$, for each operating parameter $P_{Fi}$, or compares the first value $v_{PFi,j}$ having the most recent attribution date $Date_{v_{PFij}}$ among the attribution dates associated with the first values of the historical initial $V_{PFi}$ with the second value $v'_{PFi,j}$ having the most recent attribution date $Date'_{v_{PFij}}$ among the attribution dates associated with the second values of second historical $V'_{PFi}$.

It will be noted that in this document the term "most recent attribution date" will mean that this has occurred later than another in the period in which the burner has been in use.

The first value having the most recent attribution date among the first set values for an operating parameter $P_{Fi}$, or among the first values of first historical $V_{PFi}$ will subsequently be indicated as the latest first value, $v_{PFi}$; similarly the second value having a more recent attribution date among the second values set for operating parameter $P_{Fi}$, or among the second values of second historical $V'_{PFi}$ will be indicated below as the latest second value $\hat{v}'_{PFi}$.

For each operating parameter $P_{Fi}$, if the latest first and second values $\hat{v}_{PFi}$, $\hat{v}'_{PFi}$ differ from each other, control system 100 will change one of the latest first or second values $\hat{v}_{PFi}$, $\hat{v}'_{PFi}$ in such a way that they are the same. Specifically, for each operating parameter $P_{Fi}$, control system 100 compares the attribution dates $Date_{v_{PFij}}$, $Date'_{v_{PFij}}$ for the latest first and second values $\hat{v}_{PFi}$, $\hat{v}'_{PFi}$ and copies the latest first value $\hat{v}_{PFi}$ into second memory 5 if the corresponding attribution date $Date_{v_{PFij}}$ is more recent than the attribution date $Date'_{v_{PFij}}$ of the latest second value $\hat{v}'_{PFi}$ or, respectively, copies the latest second value $\hat{v}'_{PFi}$ into first memory 3 if the corresponding attribution date $Date'_{v_{PFij}}$ is more recent than the attribution date $Date_{v_{PFij}}$ of the latest first value $\hat{v}_{PFi}$. Thus, the latest first value and the latest second value $v_{PFi}$, $\hat{v}'_{PFi}$ are the same.

In addition to this, for each operating parameter $P_{Fi}$ control system 100 may provide a stage of copying the attribution date $Date_{v_{PFij}}$ for the latest first value $\hat{v}_{PFi,j}$ into second memory 5, or respectively, copying the attribution date $Date'_{v_{PFij}}$ of the latest second value $\hat{v}'_{PFi,j}$ into first memory 3.

Also, for each operating parameter $P_{Fi}$ control system 100 may provide for a stage changing the second historical $V'_{PFi}$ in such a way that it is equal to the first historical $V_{PFi}$ if the attribution date $Date_{v_{PFij}}$ of the latest first value $\hat{v}_{PFi}$ is more recent than the attribution date $Date'_{v_{PFij}}$ of the latest second value $\hat{v}'_{PFi}$ or, respectively, change the first historical $V_{PFi}$ in such a way that it is the same as the second historical $V'_{PFi}$ if the attribution date $Date'_{v_{PFij}}$ for the latest second value $\hat{v}'_{PFi}$ is more recent than the attribution date $Date_{v_{PFij}}$ of the latest first value $\hat{v}_{PFi}$.

The stage of automatic alignment is thus performed for each operating parameter $P_{F1}, \ldots, P_{Fi}, \ldots, P_{FM}$ through the two-way transmission of data.

By way of example, it is assumed that at 09:00 on Jan. 4, 2013, control system 100 compares the latest first and second values $\hat{v}_{PF1}$, $\hat{v}'_{PF1}$ for operating parameter $P_{F1}$, in which:

the latest first value attributed to operating parameter $P_{F1}$ is equal to $\hat{v}_{PF1}$=0.5 with an attribution date $Date_{v_{PFij}}$=20/03/2013, 10:30 and the corresponding first historical value is the following, $V_{PF1}$={0.5; 0.3; 0.2; 0.7}, stored in first memory 3;

the latest second value attributed to operating parameter $P_{F1}$ is equal to $\hat{v}'_{PF1}$=0.4 with an attribution date $Date'_{v_{PFij}}$=19/03/2013, 11:00 and the corresponding second historical value is the following, $V'_{PFi}$={0.4; 0.3; 0.6; 0.5}, stored in second memory 5.

Thus, the latest first value $\hat{v}_{PF1}$ and the latest second value $\hat{v}'_{PFi}$ for operating parameter $P_{F1}$ are different, and the latest first value $\hat{v}_{PF1}$ is more recent than the latest second value $\hat{v}'_{PF1}$, control system 100 will change the latest second value, $\hat{v}'_{PF1}$, giving it the value 0.5.

Control system 100 also provides for aligning second historical $V'_{PF1}$ for operating parameter $P_{F1}$ by changing it in such a way that it is the same as first historical $V_{PF1}$.

In the case of manual alignment, control system 100 compares the latest first and second values $\hat{v}_{PFi}$ $\hat{v}'_{PFi}$ set for each operating parameter $P_{F1}, \ldots, P_{Fi}, \ldots, P_{FM}$, indicating these values, together with, if appropriate, their corresponding attribution dates $Date_{v_{PFij}}$, $Date'_{v_{PFij}}$, to an operator, by means for example of a pop-up displayed on display 8.

In other words, display device 7 allows an operator to perform the abovementioned manual alignment through the user interface.

By means of display device 7, the operator may select which of the latest first and second values $\hat{v}_{PFi}$, $\hat{v}'_{PFi}$ displayed to keep and which to change for each operating parameter $P_{Fi}$, possibly independently from the attribution date.

Following such a choice control system 100 changes the latest first or second value $\hat{v}_{PFi}$, $\hat{v}'_{PFi}$ together with the corresponding attribution date in relation to the abovementioned choice in such a way that these values are the same, or the same as the operating parameter $P_{Fi}$ which has to be kept. In addition to this control system 100 changes the first or second historical $V_{PFi}$, $V'_{PFi}$ for operating parameter $P_{Fi}$ so that they are the same or the same as the historical value relating to the value of the operating parameter $P_{Fi}$ which has to be kept.

Alternatively, through display device 7, for example by means of a user interface, control system 100 indicates only operating parameters $P_{Fi}$ having the latest first value $\hat{v}_{PFi}$ and the latest second value $\hat{v}'_{PFi}$, which are different, to an operator such as a specialist engineer.

Alternatively, through display device 7, for example, by means of a user interface, control system 100 enables a specialist engineer to make a single choice, which makes it possible to change the values for all the operating parameters $P_{F1}, \ldots, P_{Fi}, \ldots, P_{FM}$, changing the first historical $V_{PFi}$ for each operating parameter, $P_{Fi}$ in such a way that it is the same as the second historical $V'_{PFi}$ for that parameter, or, respectively, by changing the second historical $V'_{PFi}$ for each operating parameter $P_{Fi}$ in such a way that it is the same as the first historical $V_{PFi}$ for that parameter.

The manual alignment stage is particularly useful when setting up the burner, when it is useful to duplicate the data present in first memory 3 in second memory 5 (or vice versa) so that the two memories are aligned.

The stage of manual alignment is particularly appropriate if it is necessary to replace control board 6, as it makes it possible to copy the data previously stored in second memory 5 into the first memory 3 of the new control board 6.

Similar considerations may apply if display device 7 is replaced.

The method and system for controlling the operation of a burner may therefore comprise both automatic and manual setting of set parameters $P_{R1}, \ldots, P_{RT}$ and a stage of automatic and manual alignment of operating parameters $P_{F1}, \ldots, P_{Fi}, \ldots, P_{FM}$.

Preferably the method and system for controlling the operation of a burner comprise the automatic and manual setting of set parameters $P_{R1}, \ldots, P_{RT}$ and the stage of automatic alignment of operating parameters $P_{F1}, \ldots, P_{Fi}, \ldots, P_{FM}$. Manual alignment of values for operating parameters $P_{F1}, \ldots, P_{Fi}, \ldots, P_{FM}$ allows a qualified operator to select, through display device 7, the value of each operating parameter $P_{F1}, \ldots, P_{Fi}, \ldots, P_{FM}$ which has to be set and/or change and respectively keep between first and second value $v_{PFi,j}$, $v'_{PFi,j}$, allows to keep the values of operating parameters $P_{F1}, \ldots, P_{Fi}, \ldots, P_{FM}$ which are useful to him. The method and system to which the invention relates therefore constitute a system for the redundancy or back-up of information relating to operating parameters $P_{F1}, \ldots, P_{Fi}, \ldots, P_{FM}$ in control system 100.

Any replacement of control board 6 due to malfunction will not cause the loss of data stored in first memory 3, such as first values $v_{PFi,j}$ of operating parameters $P_{F1}, \ldots, P_{Fi}, \ldots, P_{FM}$, as these values are duplicated and stored as second values $v'_{PFi,j}$ in second memory 5 incorporated in display device 7, and in addition to this, second values $v'_{PFi,j}$ can be copied into a replacement memory, through display device 7, completely restoring the operating conditions of the burner preceding replacement of the memory board. As mentioned, this duplication is performed during the stage of automatic or manual alignment.

Following replacement of control board 6, the stage of manual alignment makes it possible to duplicate the data stored in second memory 5 into the first memory 3 of a new control board 6 fitted to the burner, through display device 7.

Also, because the values attributed to operating parameters $(P_{F1}, \ldots, P_{Fi}, \ldots, P_{FM})$ are duplicated through alignment between the first and second values stored in first and second memories 3, 5 respectively, there is no risk that values will be lost and/or lost from the burner in the event of a fault in control board 6 or display device 7.

Obviously a similar advantage can be obtained if display device 7 is replaced, in which the data stored in first memory 3 can be duplicated in second memory 5 of a new display device 7 installed into the burner.

The embodiments of the invention make it possible to avoid the use of a non-volatile external memory connected to control board 6, which will substantially increase the overall cost of control system 100. In fact control system 100 does not need an additional external memory unit, as it also uses non-volatile memory 5 present in display device 7 to store operating parameters $P_{F1}, \ldots, P_{Fi}, \ldots, P_{FM}$.

Display device 7 according to the invention incorporates several separate technical functions, such as to make the use of further devices which would render the burner control system more costly and complex superfluous.

In fact display device 7 according to the invention makes it possible to store the second values of parameters in memory, aligning the first and second values, and manage operation of the burner and display and set (for example by means of a user interface) at least one of the first and/or second values of the operating parameters $P_{F1}, \ldots, P_{Fi}, \ldots, P_{FM}$ during installation of the burner or its control system, or while the burner is in operation.

It will be appreciated that a system for controlling the operation of a burner comprising control board 6 and display device 7 described above, in which these components are operatively connected together and communicate through two-way data transmission, constitutes an architecturally simple and operatively independent apparatus configured to both manage operation of the burner and duplicate the values attributed to the operating parameters $(P_{F1}, \ldots, P_{Fi}, \ldots, P_{FM})$.

The memory in display device 7 is also used to duplicate the values attributed to operating parameters $P_{F1}, \ldots, P_{Fi}, \ldots, P_{FM}$, aligning the data present in the memory in control board 6 with the data present in the memory of display device 7, or vice versa. Finally it will be appreciated that the invention provides a burner which is operatively independent, incorporating both the control board and a display device, which are operatively connected together by means of two-way data transmission.

The invention claimed is:

1. A method for controlling the operation of a burner, the burner including a control board (6) associated with a first control unit (2) and a first memory (3) capable of storing first values $(v_{PF1,j}, \ldots, v_{PFi,j}, \ldots, v_{PFM,j})$ of operating parameters $(P_{F1}, \ldots, P_{Fi}, \ldots, P_{FM})$ of the burner, and a display device (7) for displaying one or more items of data relating to the functioning of the burner, the display device (7) including a second memory (5) capable of storing second values $(v'_{PF1,j}, \ldots, v'_{PFi,j}, \ldots, v'_{PFM,j})$ of operating parameters $(P_{F1}, \ldots, P_{Fi}, \ldots, P_{FM})$ of the burner, each first and second value $(v_{PFi,j}, v'_{PFi,j})$, of the operating parameters $(P_{F1}, \ldots, P_{Fi}, \ldots, P_{FM})$ being capable of being changed over time, the method comprising:

setting for each operating parameter $(P_{Fi})$ at least one first value $(v_{PFi,j})$ in the first memory (3), and setting for each operating parameter $(P_{Fi})$ at least one second value $(v'_{PFi,j})$ in the second memory (5), each of the first and second values being optimized based on operation of the burner;

comparing, for each operating parameter $(P_{Fi})$, a corresponding first value $(v_{PFi,j})$ and second value $(v'_{PFi,j})$;

if the first value $(v_{PFi,j})$ and the second value $(v'_{PFi,j})$ are different, changing one of the first or second values $(v_{PFi,j})$, $(v'_{PFi,j})$ so that the first and second values $(v_{PFi,j})$, $(v'_{PFi,j})$ are the same;

wherein the step of setting at least a first value $(v_{PFi,j})$ and/or second value $(v'_{PFi,j})$ of at least one of the operating parameters $(P_{F1}, \ldots, P_{Fi}, \ldots, P_{FM})$ is performed through the display device (7).

2. The method according to claim 1, comprising displaying on the display device (7) at least one of the first or second values $(v_{PF1,j}, \ldots, v_{PFi,j}, \ldots, v_{PFM,j}; v'_{PF1,j}, \ldots, v'_{PFi,j}, \ldots v'_{PFM,j},)$ of the operating parameters $(P_{F1}, \ldots, P_{Fi}, \ldots, P_{FM})$.

3. The method according to claim 1, wherein the step of making changes is performed through the display device (7).

4. The method according to claim 1, comprising two-way data transmission between the display device (7) and the control board (6).

5. The method according to claim 1, wherein provision is made in the setting step for comprising associating a corresponding attribution date ($Date_{\nu_{PFij}}$, $Date'_{\nu_{PFij}}$) with each first value ($\nu_{PFi,j}$) and each second value ($\nu'_{PFi,j}$), and storing that attribution date ($Date_{\nu_{PFij}}$, $Date'_{84\ PFij}$) together with each corresponding first and second value ($\nu_{PFi,j}$, $\nu'_{PFi,j}$) in the first memory (3) or in the second memory (5) respectively.

6. The method according to claim 1, wherein provision is made in the comparison step for comparing the first value ($\nu_{PFi,j}$) and the second value ($\nu'_{PFi,j}$) having the most recent attribution date ($Date_{\nu_{PFij}}$) for each operating parameter ($P_{F1}, \ldots, P_{Fi}, \ldots, P_{FM}$).

7. The method according to claim 1, wherein provision is made in the step of making changes for changing the first value ($\nu_{PFi,j}$) if the attribution date ($Date'_{\nu_{PFij}}$) of the second value ($\nu'_{PFi,j}$) is more recent than the attribution date ($Date_{\nu_{PFij}}$) of the first value ($\nu_{PFi,j}$) or, alternatively, the second value ($\nu'_{PFi,j}$) if the attribution date ($Date_{\nu_{PFij}}$) of the first value ($\nu_{PFi,j}$) is more recent than the attribution date ($Date'_{\nu_{PFij}}$) of the second value ($\nu'_{PFi,j}$).

8. The method according to claim 1, comprising also storing a first historical value ($V_{PFi}$) and a second historical value ($V'_{PFi}$), or all the first and second values ($\nu_{PFi,j}$, $\nu'_{PFi,j}$) adopted for each parameter in a time (T), in the first memory (3) and the second memory (5) respectively, in which the step of making changes comprises changing the first or second historical values ($V_{PFi}$), ($V'_{PFi}$) in such a way that the first and second historical values ($V_{PFi}$), ($V'_{PFi}$) are the same.

9. The method according to claim 1, wherein making changes comprises copying the second values ($\nu'_{PFi,j}$) in first memory (3) or respectively copying the first values ($\nu_{PFi,j}$) of the operating parameters ($P_{F1}, \ldots, P_{Fi}, \ldots, P_{FM}$) in the second memory (5).

10. The method according to claim 1, wherein the step of comparison between the first values ($\nu_{PFi,j}$) and the second values ($\nu'_{PFi,j}$) of the operating parameters ($P_{F1}, \ldots, P_{Fi}, \ldots, P_{FM}$) is performed automatically by the first control unit (2), at a pre-set frequency in time.

11. The method according to claim 1, wherein the step of making changes comprises displaying a request for a choice between:

changing the first value ($\nu_{PFi,j}$) in such a way that it is the same as the second value ($\nu'_{PFi,j}$) or, alternatively, changing the second value ($\nu'_{PFi,j}$) in such a way that it is the same as the first value ($\nu_{PFi,j}$); in the display device (7).

12. The method according to claim 1, wherein the operating parameters ($P_{F1}, \ldots, P_{Fi}, \ldots, P_{FM}$) comprise set parameters ($P_{R1}, \ldots, P_{RT}$) and user parameters $P_{U1}, \ldots, P_{UL}$).

13. The method according to claim 12, wherein the set parameters ($P_{R1}, \ldots, P_{RT}$) comprise:

a safety parameter, indicating the waiting time needed to check that a flame is present within a combustion chamber of the burner after the signal for igniting it has been started; or a parameter relating to post-ventilation; or a parameter associated with a set-point for the burner operating temperature.

14. The method according to claim 1, wherein transmission of the first values ($\nu_{PFi,j}$) of the operating parameters ($P_{F1}, \ldots, P_{Fi}, \ldots, P_{FM}$) from the first memory (3) to the second memory (5) and/or transmission of the second values ($\nu'_{PFi,j}$) of the operating parameters ($P_{F1}, \ldots, P_{Fi}, \ldots, P_{FM}$) from the second memory (5) to the first memory (3) takes place by means of a cable, optical fibre or in wireless mode.

15. The method according to claim 1, wherein the control system (100) comprises automatic and/or manual adjustment of the first values of the set parameters ($P_{R1}, \ldots, P_{RT}$) stored in the first memory (3).

16. The method according to claim 1, wherein the control system (100) comprises an automatic and/or manual algorithm for duplicating the first values of the set parameters ($P_{R1}, \ldots, P_{RT}$) stored in the first memory (3).

17. A system for controlling the operation of a burner comprising:

a control board (6) provided on the burner and provided with a first control unit (2) and a first memory (3) configured to store first values ($\nu_{PF1,j}, \ldots, \nu_{PFi,j}, \ldots, \nu_{PFM,j}$,) of operating parameters ($P_{F1}, \ldots, P_{Fi}, \ldots, P_{FM}$) of the burner, a display device (7) including a second memory (5) configured to store second values ($\nu'_{PF1,j}, \ldots, \nu'_{PFi,j}, \ldots, \nu'_{PFM,j}$) of operating parameters ($P_{F1}, \ldots, P_{Fi}, \ldots, P_{FM}$) of the burner, each of the first and second values ($\nu_{PFi,j}$, $\nu'_{PFi,j}$) of the operating parameters ($P_{F1}, \ldots, P_{Fi}, \ldots, P_{FM}$) being capable of being optimized based in operation of the burner, wherein:

the display device (7) is located on the burner, and at least one of: the control board (6), or the display device (7) are configured to compare, for each operating parameter ($P_{Fi}$), a corresponding first value ($\nu_{PFi,j}$) and second value ($\nu'_{PFi,j}$) and to change one of the first or second values ($\nu_{PFi,j}$), ($\nu'_{PFi,j}$) in such a way that the first and the second values ($\nu_{PFi,j}$), ($\nu'_{PFi,j}$) are the same if the first value ($\nu_{PFi,j}$) and the second value ($\nu'_{PFi,j}$) are different.

18. The control system according to claim 17, wherein the display device (7) and the control board (6) comprise an input/output I/O unit (61,71) to perform two-way transmission of data between the control board (6) and the display device (7) to copy the first values ($\nu_{PFi,j}$) into the second memory (5) or to copy the second values ($\nu'_{PFi,j}$) into the first memory (3).

19. The control system according to claim 17, wherein the display device (7) comprises a display (8) to display at least one datum relating to operation of the burner.

20. The control system according to claim 17, further comprising a user interface for setting at least one of the first or second values of the operating parameters ($P_{F1}, \ldots, P_{Fi}, \ldots, P_{FM}$) by the user interface.

21. A burner including a control system according to claim 17.

22. A burner according to claim 21, comprising an actuator to operate the burner and adjust operation thereof based on at least one of the first ($\nu_{PFi,j}$) or second ($\nu'_{PFi,j}$) values of the operating parameters ($P_{F1}, \ldots, P_{Fi}, \ldots, P_{PM}$).

* * * * *